United States Patent [19]

Boulet et al.

[11] Patent Number: 4,836,303

[45] Date of Patent: Jun. 6, 1989

[54] DEVICE FOR THE REMOTE ADJUSTMENT OF THE RELATIVE ORIENTATION OF TWO SECTIONS OF A COLUMN

[75] Inventors: Jean Boulet, Paris; Pierre Morin, Levallois Perret, both of France

[73] Assignees: SMF International, Sur Loire; Institut Francais du Petrole, Malmaison, both of France

[21] Appl. No.: 213,088

[22] Filed: Jun. 29, 1988

[30] Foreign Application Priority Data

Jun. 30, 1987 [FR] France ..... 87 09230

[51] Int. Cl.[4] ..... E21B 7/08

[52] U.S. Cl. ..... 175/74; 175/256

[58] Field of Search ..... 175/45, 73, 74, 75, 175/78, 256, 320; 285/184, 282

[56] References Cited

U.S. PATENT DOCUMENTS 4,220,214 9/1980 Benoit ..... 175/74 X
4,303,135 12/1981 Benoit ..... 175/73
4,745,982 5/1988 Wenzel ..... 175/74

FOREIGN PATENT DOCUMENTS 212316 3/1987 European Pat. Off. .
2432079 2/1980 France .
2453268 10/1980 France .
2453269 10/1980 France .
2491989 4/1982 France .
2519686 7/1983 France .
2575793 7/1986 France .

*Primary Examiner*—Stephen J. Novosad
*Assistant Examiner*—John F. Letchford
*Attorney, Agent, or Firm*—Fay, Sharpe, Beall, Fagan, Minnich & McKee

[57] ABSTRACT

The device comprises a variable-angle elbow coupling (14) interposed between the ends (12, 13) of two successive sections of a column. The coupling (14) comprises a first rectilinear tubular element (14*a*) and a second rectilinear tubular element (14*b*) connected to the element (14*a*) and mounted to be rotatable relative to the element (14*a*) about an axis (16). The axis of the tubular element (14) makes a non-zero angle with the axis (18) of the first section of the column. The end portions of the elements (14*a*, 14*b*) are radially offset relative to the axis (18) of the column and connected to the first section (12) and the second section (13) respectively by detachable rigid tubular elbow couplings (15*a*, 15*b*). The device of the invention is applicable to a drilling column.

10 Claims, 5 Drawing Sheets

DEVICE FOR THE REMOTE ADJUSTMENT OF THE RELATIVE ORIENTATION OF TWO SECTIONS OF A COLUMN

The invention relates to a device for the remote adjustment of the orientation, relative to the axis of a first section of a column, of a second section following on the first section. The present invention may be applicable to a drilling column comprising a drill head disposed at the end of the drilling column proper.

A drilling column comprises an assembly of tubular rods fixed to each other end to end, this column having at its end a drill head comprising a tool and a bottom motor. The drill head constitutes the lower section of the column which is at the bottom of the hole during the drilling. The drilling column proper, formed by a succession of tubular rods, constitutes the upper section whose end remote from the drill head is located on the surface and permits, in particular, supplying drilling fluid to the column. The drilling fluid flows inside the column throughout its length down to the bottom of the hole which it cleans and also drives the bottom motor. The bottom motor in turn drives the drill bit in rotation.

In the drilling art, it has become necessary to effect steered drillings, i.e. drillings with a modification and an adjustment of the path of the drilling tool.

For this purpose, it has usually been proposed to adjust the orientation of the drill head relative to the column proper by means of an elbow coupling which determines the orientation of the drilling.

In the oldest technique, the elbow coupling is a rigid coupling whose angle is predetermined. Each time it is desired to modify the path of the drilling, the drilling column must be raised up to the surface in order to adapt a new elbow coupling whose angle is chosen in accordance with the desired deviation.

Articulated elbow couplings have also been proposed which comprise two tubular parts capable of being placed either in alignment with each other or in a position in which their axes make an angle of a given value. Such articulated couplings therefore permit obtaining only a single orientation of the drilling head relative to the column. When such articulated couplings are used, it is also necessary to raise up to the surface at least one component element of the coupling when the desired deviation is incompatible with the angle that the two parts of the coupling are capable of forming.

More recently, it has been proposed in the French Pat. Nos. 2,432,079, 2,453,268, 2,453,269, 2,491,989, 2,519,686, filed by the Institut Francais du Petrole, a remote adjustmentled elbow coupling having a variable angle which is interposed between two sections of the drilling column and generally between the column proper and the drilling head. Such an elbow coupling enables the orientation of the drilling head constituting the lower section of the column to be remote adjusted, relative to the axis of the upper section whose end is located on the surface. The variable-angle elbow coupling comprises a first rectilinear tubular element integral with the upper section of the column and a second rectilinear tubular element integral with the end of the lower section of the drilling column. The second tubular element is connected to the first and mounted relative to the first element to be rotatable about an axis making a non-zero angle $\alpha$ with the axis of the first tubular element which is coincident with the axis of the upper section of the column with respect to which the orientation of the lower section is effected.

The axis of the first tubular element, the axis of the second tubular element and the axis of rotation intersect at a common point. The second tubular element has a reference position in which its axis is aligned with the axis of the first tubular element and consequently with the axis of the drilling column. In this position of the elbow coupling, the drilling column is completely rectilinear.

Remote adjustment means controlled from the surface enable the second tubular element to be turned relative to the first tubular element about its axis of rotation.

In the course of this rotation from its reference position, the second tubular element has a disalignment relative to the first tubular element which varies between 0 and a maximum value equal to $2\alpha$. The maximum disalignment is achieved by turning the second tubular element through 180° from its reference position about its axis of rotation.

The rotation is effected by successive steps of given amplitude so that perfectly defined successive orientations of the second tubular element relative to the first tubular element are obtained. The lower section of the drilling column integral with the second tubular element and disposed in the axial extension of this element, can therefore be oriented relative to the axis of the upper section which is coincident with the axis of the first tubular element.

The displacement in rotation of the second tubular element and the lower section of the drilling column can only be achieved after the unlocking of a shaft which ensures the connection in rotation of the two elements of the elbow coupling and therefore of the two sections of the drilling column.

The means for displacing in rotation the second tubular element relative to the first tubular element are generally actuated by the driving effect of the drilling fluid and controlled from the surface through electrical or hydraulic means.

The mechanical design of the remote adjustmentled variable-angle elbow couplings is rendered more difficult by the fact that the two tubular elements are mounted to be rotatable relative to each other about an axis of rotation which is distinct from the axis of the two tubular elements.

The elbow coupling must in addition ensure the continuity of the passage of the drilling fluid in the column.

The elbow coupling is therefore a component which is delicate and expensive to manufacture.

Moreover, the elbow coupling must be so designed as to obtain a given maximum disalignment between the two sections of the drilling column. In the case where it is desired to modify the characteristics of the elbow coupling, i.e. for example in the case where it is desired to increase the maximum angle of disalignment, a new elbow coupling must be designed and manufactured.

It is difficult to provide for a priori the manufacture of a wide range of elbow couplings to obtain variable maximum disalignments.

It is thus practically impossible to provide for a mass production of elbow couplings of use in a large number of applications.

An object of the invention is therefore to propose a device for the remote adjustment of the orientation, relative to the axis of a first section of in particular a drilling column, of a second section following on the first section, constituted by a variable-angle elbow coupling interposed between the corresponding ends of the two sections of the column and comprising a first rectilinear tubular element rigidly fixed to the end of the first section and a second rectilinear tubular element rigidly fixed to the end of the second section of the column, connected to the first element and rotatable relative to the first element about an axis making a non-zero angle $\alpha$ with the axis of the first section of the column, the device further comprising mechanical means for interconnecting in rotation the two tubular elements, and remote adjustment means for shifting in rotation in a controlled manner the second element relative to the first element, said device permitting a simplification of the design and manufacture of the elbow coupling which may be easily adapted to variable maximum disalignment angles by employing adaptation elements of simple structure.

For this purpose, the axis of the rectilinear first tubular element makes a non-zero angle with the axis of the first section of the column and the end portions of the first and second rectilinear tubular elements are connected to the corresponding end portions of the first and second sections of the column by detachable rigid elbow tubular couplings, each of said end portions of the tubular elements being radially offset relative to the axis of the first section of the column.

In order to explain the invention, there will now be described, by way of a non-limitative example with reference to the accompanying drawings, several embodiments of an adjusting device according to the invention.

Figure 1:
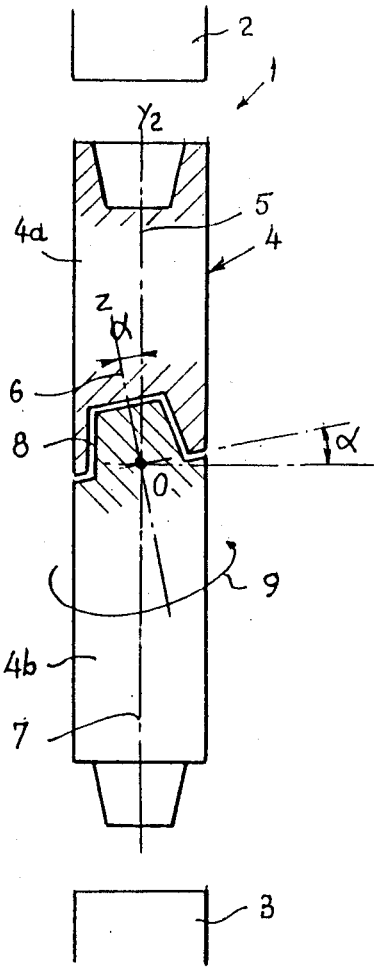
FIG. 1 (PRIOR ART)
FIG. 1 is a diagrammatic view of a variable-angle elbow coupling according to the prior art in its reference position.

In FIG. 1 there is shown a part of a drilling column generally designated by the reference 1. This drilling column comprises an upper section 2 and a lower section 3 interconnected by an elbow coupling 4 whereby it is possible to orient the lower section 3 carrying the drilling tool relative to the axis 5 of the upper section 2 of the drilling column.

The elbow coupling according to the prior art is formed by two tubular rectilinear elements 4*a* and 4*b* which are rigidly connected to th upper section 2 and the lower section 3 respectively. The lower tubular element 4*b* of the elbow coupling 4 is fixed to the upper tubular element 4*a* and mounted relative to this tubular element to be rotatable about an axis 6 which intersects the common axis 5 of the element 4*a* and the section 2 at a point 0 and makes with the axis 5 a non-zero angle $\alpha$. The rotative mounting of the element 4*b* on the element 4*a* is achieved by means of a conical bearing 8 shown diagrammatically. The axis 7 of the element 4*b*, which is also the axis of the section 3 of the drilling column, also passes through the point 0 on the axes 5 and 6.

In FIG. 1, the elbow coupling 4 is shown in its reference position in which the axes 5 and 7 are in alignment with each other.

Means, which are not shown but are described in the aforementioned patents, permit a remote adjustment of the shifting in rotation of the element 4*b* relative to the element 4*a* about the axis 6, as shown by the arrow 9.

Figure 2:
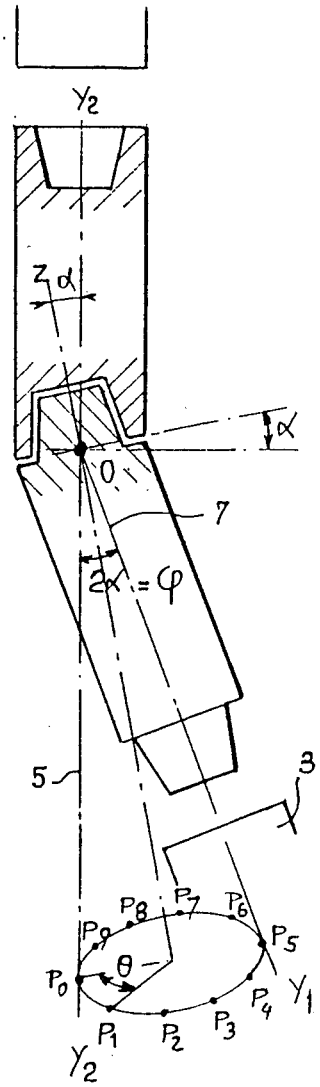
FIG. 2 (PRIOR ART)
FIG. 2 is a view of the elbow coupling shown in FIG. 1 in its maximum disalignment position.

With reference to FIG. 2, it can be seen that the rotation of the element 4*b* about the axis 6 by identical steps of value $\theta$ brings the axis 7 into successive positions defined by the points P0, P1, . . . P9. In each of these positions, the axis 7 of the element 4*b* and the lower section 3 of the drilling column makes, with the axis 5 of the upper section 2 of the drilling column, an angle $\phi$ of between 0 and $2\alpha$. The maximum disalignment angle $\phi=2\alpha$ is obtained for an angle of rotation $\theta=180°$ from the reference position PO.

In the case of a device according to the prior art such as that shown in FIGS. 1 and 2, the maximum disalignment angle $2\alpha$ therefore directly depends on the structure of the assembly of the tubular elements 4*a* and 4*b* by means of the bearing 8.

The modification of the maximum shifting angle requires a complete change of the elbow coupling 4 whose structure is provided for a well determined maximum shifting angle.

Figure 3:
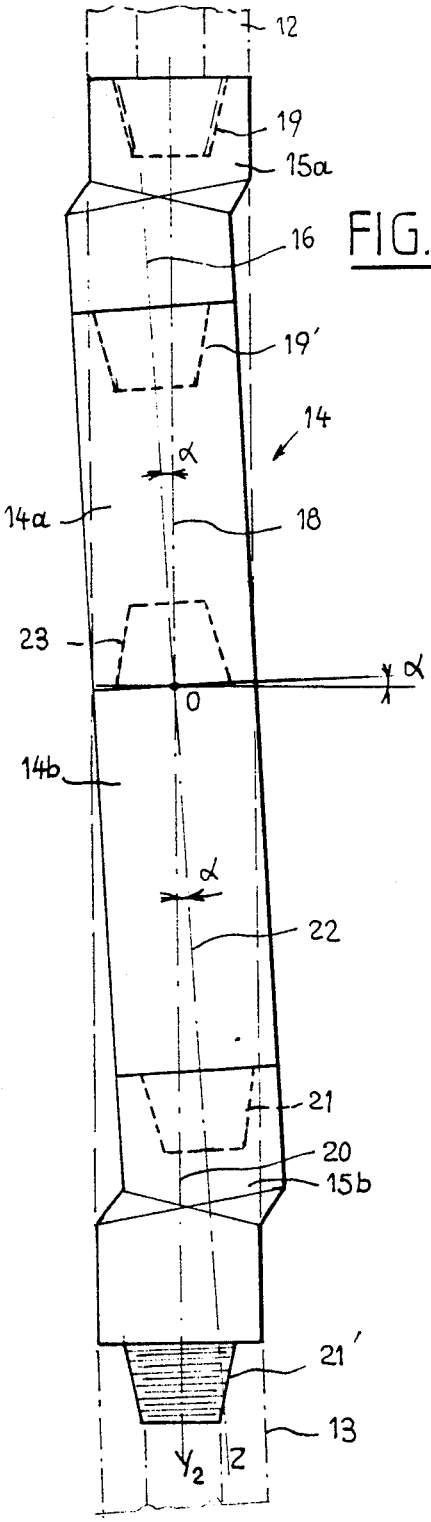
FIG. 3 is an elevational view of a variable-angle elbow coupling of an adjusting device according to a first embodiment of the invention.
Figure 3A:
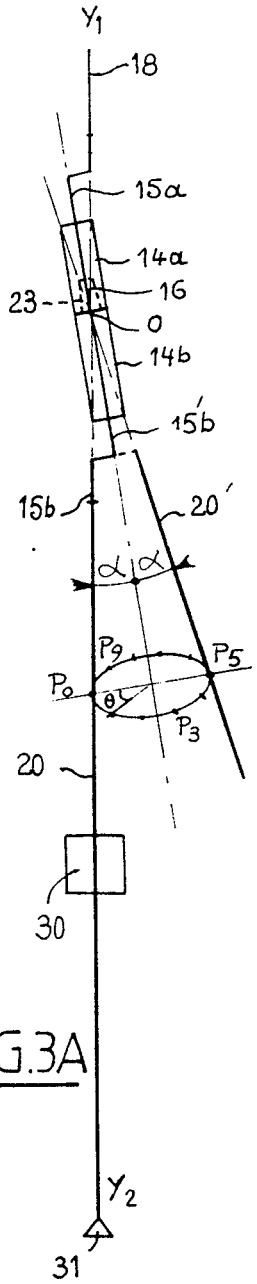
FIG. 3A is a diagrammatic view of the structure and operation of an elbow coupling such as that shown in FIG. 3.

FIGS. 3 and 3A show an elbow coupling according to the invention generally designated by the reference 14. The coupling 14 is interposed between the lower end of the upper section 12 of a drilling column and the upper end of the lower section 13 of this drilling column comprising in particular the bottom motor 30 and the drilling tool 31. The sections 12 and 13 are connected to the elbow coupling 14 by taper screw-threaded members.

The coupling 14 comprises two rectilinear tubular elements 14*a* and 14*b* and two rigid tubular elbow couplings 15*a* and 15*b*. These various elements of the elbow coupling 14 are arranged one after the other in the axial direction 18 of the drilling column and comprise aligned bores permitting a continuous circulation of the drilling fluid through the elbow coupling 14.

The upper tubular element 14*a* is rigidly fixed to the upper section 12 of the drilling column by a tubular elbow coupling 15*a* which comprises taper screw-threaded portions 19 and 19' whereby it can be connected to the section 12 and to the element 14*a* respectively.

In the same way, the lower element 14*b* is rigidly connected to the lower section 13 of the drilling column by a tubular elbow coupling 15*b* which comprises conical screw-threaded portions 21 and 21' whereby it can be connected to the element 14*b* and to the section 13 respectively.

In FIG. 3, the coupling is shown in its reference position in which the axis 20 of the lower section 13 of the drilling column is in alignment with the axis 18 of the upper section 12 of this column.

The upper tubular element 14a has an axis 16 which makes a non-zero angle $\alpha$ with the axis 18 of the upper section 12. The lower tubular element 14b is connected to the upper element 14a and rotatable relative to this element by a taper bearing 23 whose axis 16 coincides with the axis of the tubular element 14b, it making an angle $\alpha$ with the axis 18 of the upper section 12 of the drilling column.

The axis 22 of the lower tubular element 14b is also coincident with the axis 16 and thus makes an angle $\alpha$ with the axis 20 of the lower section of the drilling column.

The ends of the elements 14a and 14b connected to the elbow couplings 15a and 15b respectively are radially offset in opposite directions relative to the axis 18,20 of the drilling column.

FIG. 3A is a diagrammatic view of the tubular elements 14a and 14b and the elbow couplings 15a and 15b. The lower tubular element 14b is mounted on the upper element 14a to be rotatable about the axis 16 common to these two tubular elements. Furthermore, the axis 16 intersects the axis 18 at a point 0 and defines with the axis 18 a plane of symmetry of the coupling.

The upper section of the drilling column diagrammatically represented by its axis 18, the elbow coupling 15a and the upper tubular element 14a which are interconnected constitute the fixed parts of the drilling column during the adjustment of the orientation of the lower section diagrammatically represented by its axis 20.

This orientation adjustment is achieved by turning the lower tubular element 14b about the axis 16 of the bearing 23 A step-by-step rotation of amplitude $\theta$ of the tubular element 14b relative to the element 14a may be obtained by means of a device such as that described in the aforementioned patents of I.F.P.

The elbow coupling 14 may comprise, as described in these patents, a shaft which permits either interconnecting the elements 14a and 14b in such manner as to prevent a relative rotation thereof or shifting in rotation the element 14b reactive to the element 14a.

The element 14b which is connected to the lower section 13 having an axis 20 by means of the elbow coupling 15b, drives in rotation this lower section whose axis 20 is capable of occupying in succession the positions shown by the points P2, P3, . . . P9 from the reference position PO. When the element 14b has turned through an angle $\theta=180°$, the axis 20 occupies the position 20' represented by the point P5. The axis 20 in its position 20' makes an angle which is equal to $2\alpha$ with the initial direction 18,20, i.e. with the axis of the upper section 12 of the drilling column.

The lower section 13 of the drilling column comprising the motor 30 and the drill bit 31 is therefore capable of being oriented in successive angles relative to the upper section 12, these disalignment angles being between 0 and $2\alpha$, $\alpha$ being the angle made by the axis of rotation 16 with the axis 18 of the upper section of the drilling column.

In the embodiment shown in FIGS. 3 and 3A, the axis of rotation 16 of the element 14b relative to the element 14a is directed along the axis common to the two tubular elements 14a and 14b. The design of these elements 14a and 14b is therefore much simpler than that of the elements 4a and 4b of the device of the prior art shown in FIGS. 1 and 2. Moreover, this design does not fix the value of the angle$\alpha$ defining the maximum disalignment obtainable with the use of the coupling. This angle is determined by the shape given to the rigid tubular elbow couplings 15a and 15b.

In the case of the device shown in FIGS. 3 and 3A, the axis 16 common to the elements 14a and 14b defines with the axis 18 of the drilling column a plane of symmetry which is the plane of FIG. 3A. The axes of the elbow couplings 15a and 15b are contained in the plane and the elbow couplings 15a and 15b are symmetrical with each other with respect to the axis 18. The pivot centre 0 about which pivots the lower section 13 of the drilling column which is at the intersection of the axis 18 and the axis 16, is at an equal distance from the coupling surfaces of the elements 14a and 14b, i.e. in their junction plane, these elements having the same length. It will be understood that this is in no way a limitative arrangement and that these elements may have different lengths, the rigid elbow couplings 15a and 15b being designed accordingly.

In the case shown in FIGS. 3 and 3a, it is quite clear that, in changing the dimensions of the tubular elbow couplings 15a and 15b and in maintaining their symmetrical position relative to the axis 18, it is possible to either increase or decrease the angle $\alpha$ while maintaining the position of the point 0 in the junction plane of the elements 14a and 14b.

In this case, the couplings surfaces of the elements 14a and 14b with the tubular couplings 15a and 15b respectively are radially offset relative to the axis 18 to the same extent but in different directions.

Figure 4:
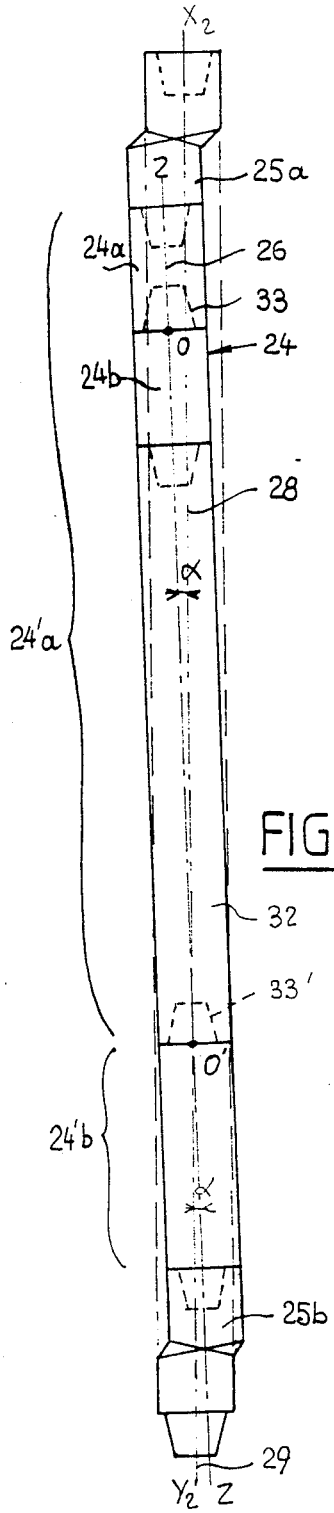
FIG. 4 is an elevational view of an elbow coupling of an orientation adjusting device according to a second embodiment of the invention.
Figure 4A:
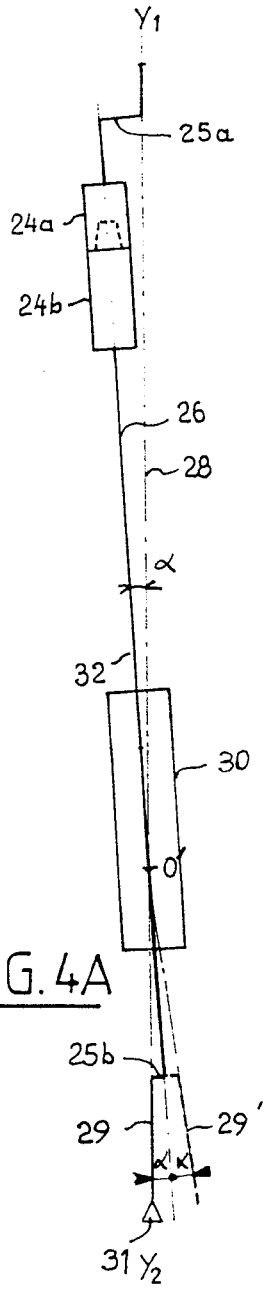
FIG. 4A is a diagrammatic view of the structure and operation of the elbow coupling shown in FIG. 4.

Shown in FIGS. 4 and 4A is a second embodiment of an elbow coupling whose tubular elements 24a and 24b are identical to the elements 14a and 14b of the device shown in FIGS. 3 and 3A. The axis of rotation 26 of the tubular element 24b relative to the tubular element 24a is coincident with the axis common to the tubular elements 24a and 24b.

The rigid tubular elbow couplings 25a and 25b have such shape and arrangement that the axis 26 makes a non-zero angle $\alpha$ with the axis 28 of the upper section of the drilling column which is coincident, in the reference position shown in FIG. 4, with the axis 29 of the lower section of the drilling column.

Furthermore, as can be seen in FIGS. 4 and 4A, the axis 26 intersects the axis 28 at a point 0' located well below the tubular elements 24a and 24b which are mounted to be relatively rotatable. This point 0' is located in the vicinity of the bottom motor 30 and a little above the drilling tool 31. This arrangement, which is obtained by employing an intermediate tubular coupling 32 for connecting the lower tubular element 24b and the elbow coupling 25b, permits substantially moving the pivot centre 0' of the lower section of the drilling column to the drilling tool 31 This arrangement facilitates the adjustment and efficiency of the orientation of the drilling. The intermediate tubular coupling 32 may include a motor 30.

When the bottom motor is located above a rigid elbow coupling 25b, the movement of rotation may be transmitted to the drilling tool through a shaft which extends through this rigid elbow coupling and includes a universal joint.

FIG. 4A shows diagrammatically the lower section of the drilling column by its axis 29.

When the tubular element 24b is rotated through 180° relative to the tubular element 24a about the axis 26 from the reference position shown in FIG. 4, the axis 29 of the lower section of the drilling column passes from the position 29 to the position 29'. In its position 29' the axis of the lower section of the drilling column makes an angle equal to $2\alpha$ with the axis 28 of the upper section.

In the arrangement shown in FIGS. 4 and 4A, the coupling surfaces of the elements 24*a* and 24*b* are radially offset relative to the axis 28 in the same direction; the axis 26 which joins the centre of these surfaces intersects the axis 28 at the point 0' located much below the elements 24*a* and 24*b*.

The axes 26 and 28 define a plane which is a plane of symmetry for the whole of the coupling and is the plane of FIG. 4A.

The tubular elbow couplings 25*a* and 25*b* have, as before, reversed positions, these couplings being placed on each side of the axis 28 by means of the coupling 32 of great length.

Shown in dotted line in FIG. 4 is the position 33' of the bearing 33 which it would be necessary to adopt for obtaining a pivot centre at 0' in the case where it would be desired to employ an elbow coupling of the type shown in FIGS. 3 and 3A in which the pivot centre is in the coupling plane of the upper and lower tubular elements. Also designated by the references 24*a'* and 24*b'* are the tubular elements which would be necessary in the case of the utilization of a device such as that shown in FIGS. 3 and 3A. It is therefore quite obvious that the arrangement of FIGS. 4 and 4A permits a considerable simplification of the design of the rotary tubular elements of the elbow coupling while shifting the pivot centre downwardly.

This result may be obtained, as indicated, by employing elements 24*a* and 24*b* which are identical to the elements 14*a* and 14*b* employed before.

Figure 5:
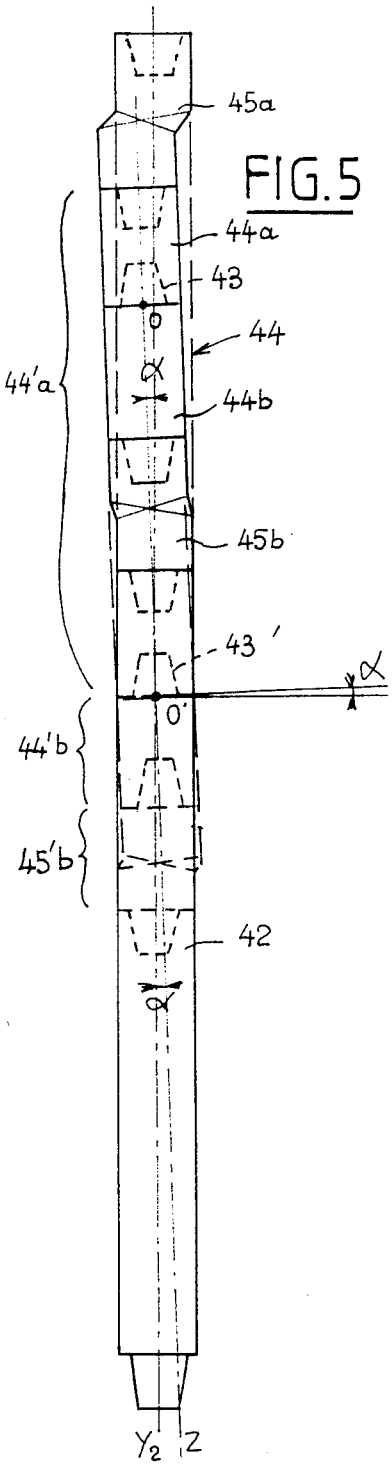
FIG. 5 is an elevational view of an elbow coupling of an orientation adjusting device according to a third embodiment of the invention.
Figure 5A:
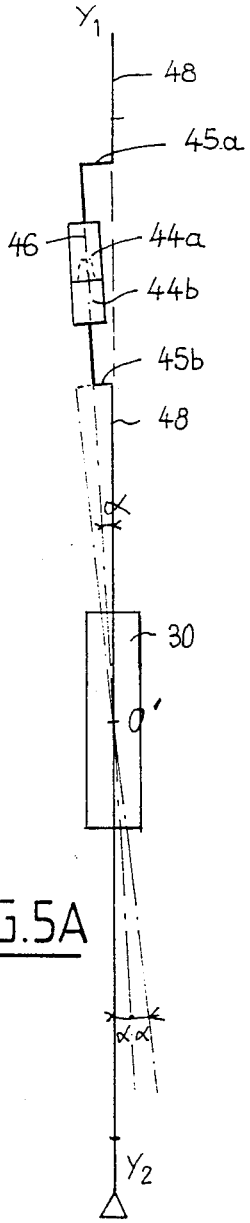
FIG. 5A is a diagrammatic view of the structure and operation of an elbow coupling such as that shown in FIG. 5.

FIGS. 5 and 5A show a third embodiment of an elbow coupling 44 comprising an upper element 44*a* and a lower element 44*b* which is mounted on the element 44*a* to be rotatable about the axis 46 common to the tubular elements 44*a* and 44*b*. The connection surfaces of the elements 44*a* and 44*b* with the corresponding elbow couplings 45*a* and 45*b* which permit connecting the tubular elements 44*a* and 44*b* to the upper section and lower section of the drilling column respectively, are offset to the same side of the axis 48 of the drilling column. The axis of rotation 46 of the tubular element 44*b* relative to the element 44*a* makes an angle $\alpha$ with the axis 48 and intersects the latter at a point 0' located in the vicinity of the bottom motor 30 of the drilling column. Advantages similar to those obtained in the case of the device shown in FIGS. 4 and 4A are thus obtained.

The position 43' of the bearing 43 is shown, as before, in dotted lines in FIG. 5, which would have to be employed to obtain equivalent results with a device of the type shown in FIGS. 3 and 3A. Furthermore, the position and the shape of the elbow coupling 45*b* ' which must be substituted for the coupling 45*b* is shown in dotted lines. The elements 44*a* and 44*b* would then be replaced by the tubular elements 44*a'* and 44*b'*. The arrangement represented in FIGS. 5 and 5A merely requires the utilization of a rectilinear tubular coupling 42 for connecting the elbow coupling 45*b* to the lower section of the drilling column.

Figure 6:
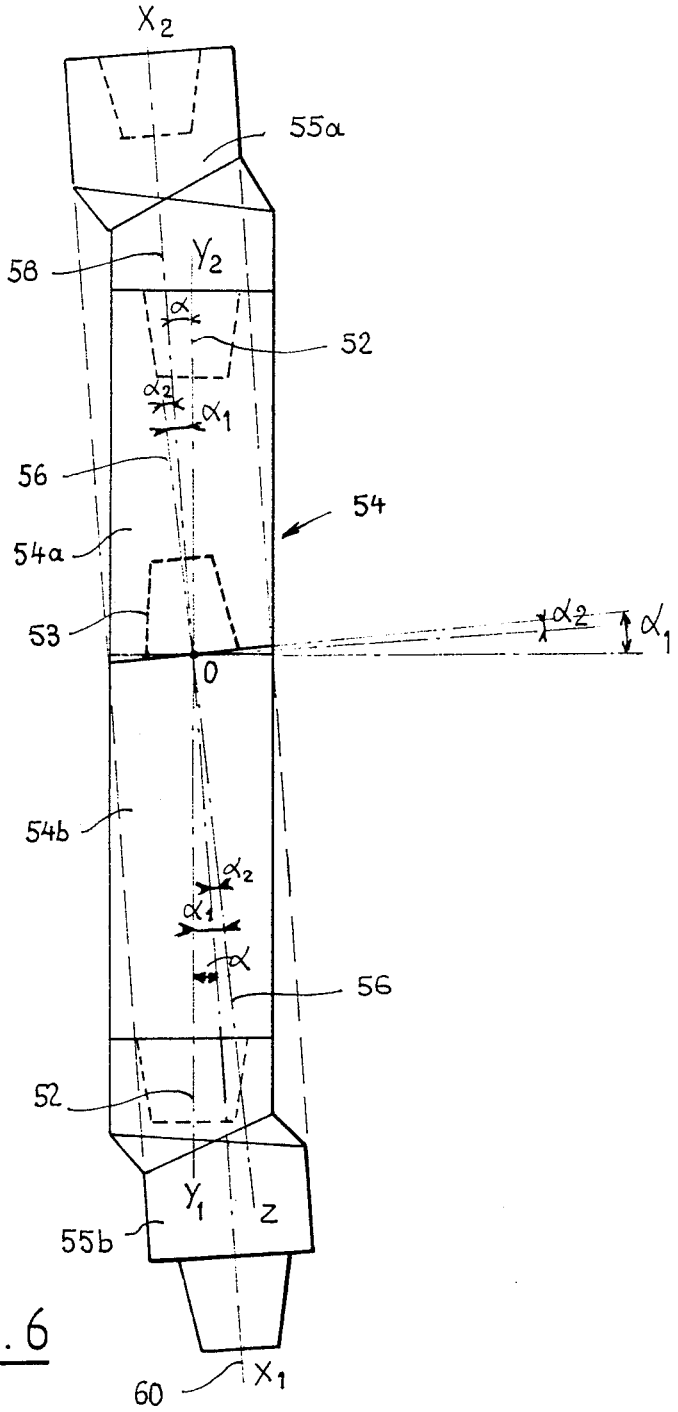
FIG. 6 is an elevational view of an elbow coupling of an adjusting device according to a fourth embodiment of the invention.

A fourth embodiment of a variable-angle elbow coupling 54 according to the invention is shown in FIG. 6.

This elbow coupling comprises, as before, two rectilinear tubular elements 54*a* and 54*b* and two elbow couplings 55*a* and 55*b*.

The elbow coupling 55*a* permits the mounting of the tubular element 54*a* on the end of the upper section of the drilling column so that the axis 52 of this tubular element 54*a* makes a certain non-zero angle $\alpha$ with the axis 58 of the upper section of the drilling column.

The tubular element 54*b* is fixed to the element 54*a* and rotatively mounted on the latter by a bearing 53 having an axis 56. The axis 56 of the bearing 53, as in the case of the device shown in FIGS. 1 and 2, makes an angle $\alpha 1$ with the axis 52 of the tubular element 54*a*.

Furthermore, the axis 56 makes an angle $\alpha 2$ with the axis 58 of the upper section of the drilling column.

In FIG. 6, the elbow coupling is shown in its reference position in which the axis 58 of the upper section of the drilling column is in alignment with the axis 60 of the lower section of this column.

When the lower tubular element 54*b* is made to rotate relative to the upper element 54*a* about the axis 56, the lower section of the drilling column will be liable to be oriented relative to the upper section with a maximum disalignment angle equal to $2\alpha 2$.

The fact of having disposed the axis 52 of the upper tubular element 44*a* with a non-zero angle $\alpha$ relative to the axis 58 of the upper section of the drilling column by using taking-up elbow couplings 55*a* and 55*b*, has permitted the transformation of a device according to the prior art of angle $\alpha 1$ into a device according to the invention of angle $\alpha 2 = \alpha 1 - \alpha$, whose maximum disalignment is $2\alpha 2 = 2\ (\alpha 1 - \alpha)$.

The device according to the invention not only permits obtaining an orientation with a coupling having two tubular elements which have a common axis about which one of the elements is mounted to be rotatable relative to the other, but also permits modifying as desired the maximum disalignment angle obtained with a device according to the prior art.

It is therefore quite clear that the device according to the invention provides great flexibility as concerns the adjustment of the maximum disalignment angle obtainable and as concerns the position of the pivot point of the section of the drilling column the orientation of which is effected. As in the devices of the prior art, the two tubular elements of the elbow coupling may be connected to rotate with each other by a remote control device.

It is also quite clear that any remote control device may be employed for achieving the step-by-step rotation of one of the orientation tubular elements relative to the other. These control or actuating means may be of any type such as that disclosed in the aforementioned patents to I.F.P..

This device may also be a remote control device such as that disclosed in the French Pat. No. 2,575,793 of the firm S.M.F. International.

The axis of rotation of the rectilinear tubular elements may not only be coplanar to the axis of the drilling column, as in the described embodiments in which these axes intersect at the pivot point of the coupling, but may also be non-coplanar. In the latter case, the two axes have no common point and the tubular elbow couplings have no common plane of symmetry.

It is quite clear that there may be associated with an assembly constituted by two rectilinear tubular elements assembled to be rotatable with respect to each other about their common axis, any type of elbow coupling and rectilinear coupling for obtaining a required orientation angle of the relative rotation axis of the tubular elements with respect to the axis of the drilling column and a required position of the pivot point of the orientable section of the drilling column, as a function of the desired result.

There may therefore be conceived a mass-production of rectilinear tubular elements mounted to be rotatable with respect to each other, it being possible to arrange that these elements be completely standardized and that the supply of suitable elbow couplings permit the obtaining of different configurations from the standard rectilinear elements. These rectilinear elements which are rotatively mounted may constitute complete mechanisms comprising the locking means and the means for achieving a relative rotation therefor.

The connecting means between the rigid elbow couplings 15*a*; 25*a*; 45*a*; 55*a*; 15*b*; 25*b*; 45*b* or 55*b* , and respectively the tubular elements 14*a*; 24*a*; 44*a*; 54*a*; 14*b*; 24*b*; 44*b* or 54*b* will have to permit a location and/or a keying of the angular position of these two component parts with respect to each other.

We claim:

1. A remote adjusting device in combination with a column comprising a first section having a longitudinal axis and an end, and a second section which has a longitudinal axis, follows on the first section and has an end, for remotely adjusting the orientation of the second section relative to said axis of the first section, said device comprising a variable-angle tubular elbow coupling interposed between and interconnecting said ends of the two sections, said elbow coupling comprising a first rectilinear tubular element having a longitudinal axis and an end portion which is fixed to said end of the first section and a second rectilinear tubular element having a longitudinal axis and an end portion which is fixed to said end of the second section and mounted relative to said first element to be rotatable about an axis making a non-zero angle with said axis of the first section of the column, the device further comprising remote control means for interconnecting in rotation said two tubular elements, and remote control means for shifting in rotation in a regulated manner said second element relative to said first element, said axis of the first rectilinear tubular element making a non-zero angle with said axis of the first section, detachable rigid tubular elbow couplings for connecting said end portions of the first tubular element and the second tubular element to the corresponding ends of the first section and the second section and for detachably coupling said elbow couplings to each corresponding said end portions of said tubular elements, each of said end portions of the two tubular elements being radially offset relative to said axis of the second section.

2. A device according to claim 1, wherein said axis of the first tubular element and said axis of the second tubular element are in alignment with each other and constitute a common axis, and the second tubular element is mounted on the first tubular element to be rotatable about said common axis.

3. A device according to claim 2, wherein said end portions of the first tubular element and the second tubular element are radially offset on each side of said axis of the first section, said common axis, which constitutes the axis of rotation of the second tubular element relative to the first tubular element, intersecting said axis of the first section at a point located between said end portions of the two tubular elements.

4. A device according to claim 2, wherein said end portions of the first tubular element and second tubular element are radially offset from said axis of the first section on the same side of said axis of the first section, said common axis, which constitutes the axis of rotation of the second tubular element relative to the first tubular element, intersecting said axis of the first section at a common point located in a position remote from the two tubular elements.

5. A device according to claim 4, wherein said first section of the column is an upper section of a drilling column and the second section of the column is a lower section of a drilling column and comprises a lower end, a bottom motor and a drilling tool provided in the lower section adjacent to said lower end, the point common to said common axis of the two tubular elements and to said axis of the upper section being located in the vicinity of the bottom motor and the drilling tool, said point constituting the pivot centre of the lower section relative to the upper section.

6. A device according to claim 4, comprising a rectilinear tubular coupling for connecting said end portion of the second tubular element to said rigid elbow coupling which is connected to said end of the second section, said rectilinear tubular coupling having an axis which is said common axis and a length greater than the distance between said end portion of the second tubular element and said common point located on said axis of the first section, the rigid tubular elbow couplings being located on each side of said axis of the first section in a plane of symmetry defined by said common axis and said axis of the first section.

7. A device according to claim 5, comprising a rectilinear tubular coupling for connecting said end portion of the second tubular element to said rigid elbow coupling which is connected to said end of the second section, said rectilinear tubular coupling having an axis which is said common axis and a length greater than the distance between said end portion of the second tubular element and said common point located on said axis of the first section, the rigid tubular elbow couplings being located on each side of said axis of the first section in a plane of symmetry defined by said common axis and said axis of the first section.

8. A device according to claim 4, wherein the rigid tubular elbow couplings for connecting said end portions of the two tubular elements with the first section and the second section respectively are disposed on the same side of said axis of the first section and in a plane of symmetry defined by said axis of the first section and said common axis.

9. A device according to claim 5, wherein the rigid tubular elbow couplings for connecting said end portions of the two tubular elements with the first section and the second section respectively are disposed on the same side of said axis of the first section and in a plane of symmetry defined by said axis of the first section and said common axis.

10. A device according to claim 1, wherein the second tubular elementis mounted relative to the first tubular element to be rotatable about an axis which is different from said axis of the first tubular element and said axis of the second tubular element and makes a non-zero angle with said axis of the first section of the column.

* * * * *